US006358092B1

(12) United States Patent
Siemon et al.

(10) Patent No.: US 6,358,092 B1
(45) Date of Patent: Mar. 19, 2002

(54) SHIELDED TELECOMMUNICATIONS CONNECTOR

(75) Inventors: John A. Siemon, Woodbury; Scott Nagel, Weston; Joshua Adams, New Hartford, all of CT (US)

(73) Assignee: The Siemon Company, Watetown, CT (US)

( * ) Notice: Subject to any disclaimer, the term of this patent is extended or adjusted under 35 U.S.C. 154(b) by 0 days.

(21) Appl. No.: 09/621,214

(22) Filed: Jul. 21, 2000

Related U.S. Application Data

(60) Provisional application No. 60/145,869, filed on Jul. 27, 1999.

(51) Int. Cl.[7] ..... H01R 13/648

(52) U.S. Cl. ..... 439/608; 439/418; 439/941; 439/676

(58) Field of Search ..... 439/344, 608, 439/941, 676, 418

(56) References Cited

U.S. PATENT DOCUMENTS

| | | | | |
|---|---|---|---|---|
| 4,601,530 A | | 7/1986 | Coldren et al. | |
| 5,147,215 A | | 9/1992 | Pritulsky | |
| 5,194,014 A | | 3/1993 | McClune et al. | |
| 5,516,984 A | | 5/1996 | Soes et al. | |
| 5,571,035 A | | 11/1996 | Ferrill | |
| 5,628,647 A | | 5/1997 | Rohrbaugh et al. | |
| 5,655,284 A | | 8/1997 | Ferrill et al. | |
| 5,888,100 A | | 3/1999 | Bofill et al. | |
| 5,899,770 A | * | 5/1999 | Ezawa | 439/941 |
| 6,080,007 A | * | 6/2000 | Dupuis et al. | 439/941 |
| 6,083,052 A | | 7/2000 | Adams et al. | |

FOREIGN PATENT DOCUMENTS

| | | |
|---|---|---|
| EP | 0 840 406 A2 | 5/1998 |
| EP | 0 847 111 A2 | 6/1998 |
| WO | WO 99/30388 | 6/1999 |
| WO | WO 99/36997 | 7/1999 |
| WO | WO 99/52182 | 10/1999 |

OTHER PUBLICATIONS

RIT, CLASSix (Cat 6) Modular Plug (RJ–45) Installation Instructions, Instruction Sheet 4462210, Mar. 2000.

* cited by examiner

*Primary Examiner*—Tho D. Ta
(74) *Attorney, Agent, or Firm*—Cantor Colburn LLP

(57) ABSTRACT

An exemplary embodiment of the invention is a telecommunications plug for use with a cable having a plurality of wires arranged in a plurality of pairs. The telecommunications plug includes a housing and a load bar positioned within the housing. The load bar positions wires relative to each other in the housing. An isolator is positioned in the housing and is conductive for isolating a first pair of wires from a second pair of wires.

9 Claims, 17 Drawing Sheets

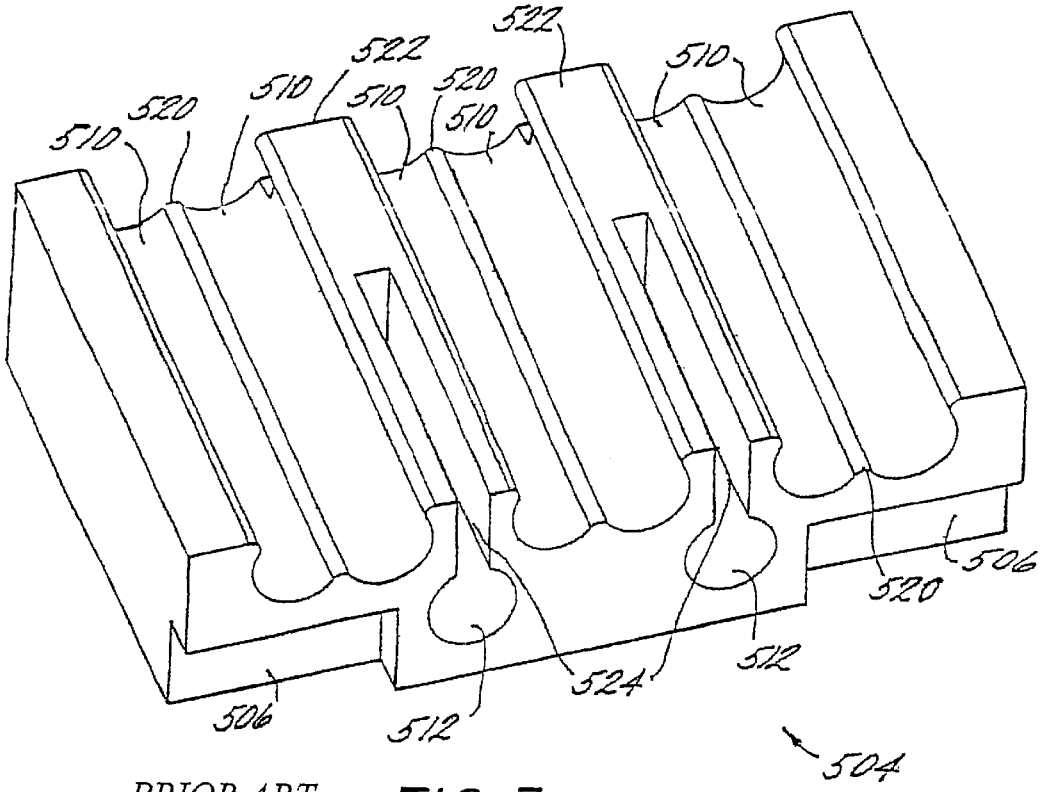
PRIOR ART FIG. 3
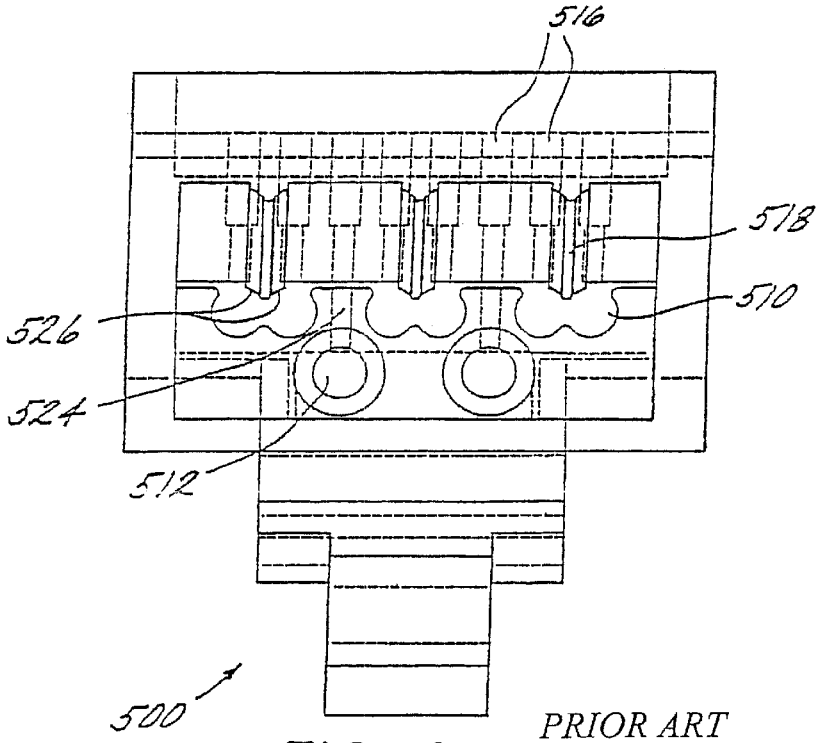
PRIOR ART
FIG. 4

SHIELDED TELECOMMUNICATIONS CONNECTOR

CROSS REFERENCE TO RELATED APPLICATIONS

This application claims the benefit of U.S. provisional patent application serial number 60/145,869 filed Jul. 27, 1999, the entire contents of which are incorporated herein by reference.

BACKGROUND OF THE INVENTION

The invention relates generally to an enhanced performance connector and in particular to a telecommunications plug having internal shielding to reduce crosstalk. Improvements in telecommunications systems have resulted in the ability to transmit voice and/or data signals along transmission lines at increasingly higher frequencies. Several industry standards that specify multiple performance levels of twisted-pair cabling components have been established. The primary references, considered by many to be the international benchmarks for commercially based telecommunications components and installations, are standards ANSI/TIA/EIA-568-A (/568) Commercial Building Telecommunications Cabling Standard and 150/IEC 11801 (/11801), generic cabling for customer premises. For example, Category 3, 4 and 5 cable and connecting hardware are specified in both /568 and /11801, as well as other national and regional specifications. In these specifications, transmission requirements for Category 3 components are specified up to 16 MHZ. Transmission requirements for Category 4 components are specified up to 20 MHZ. Transmission requirements for Category 5 components are specified up to 100 MHZ. New standards are being developed continuously and currently it is expected that future standards will require transmission requirements of at least 600 MHZ.

The above referenced transmission requirements also specify limits on near-end crosstalk (NEXT). Often, telecommunications connectors are organized in sets of pairs, typically made up of a tip and ring connector. As telecommunications connectors are reduced in size, adjacent pairs are placed closer to each other creating crosstalk between adjacent pairs. To comply with the near-end crosstalk requirements, a variety of techniques are used in the art. While there exist plugs, outlets and connecting blocks designed to reduce crosstalk and enhance performance, it is understood in the art that improved plugs, and outlets and connecting blocks are needed to meet increasing transmission rates.

SUMMARY OF THE INVENTION

The above-discussed and other drawbacks and deficiencies of the prior art are overcome or alleviated by the enhanced performance connector of the present invention. An exemplary embodiment of the invention is a telecommunications plug for use with a cable having a plurality of wires arranged in a plurality of pairs. The telecommunications plug includes a housing and a load bar positioned within the housing. The load bar positions wires relative to each other in the housing. An isolator is positioned in the housing and is conductive for isolating a first pair of wires from a second pair of wires.

BRIEF DESCRIPTION OF THE DRAWINGS

Referring now to the drawings wherein like elements are numbered alike in the several figures:

FIG. 3 is a perspective view of the load bar of the plug of FIG. 1;

FIG. 4 is an end view of the plug of FIG. 1;

DESCRIPTION OF THE PREFERRED EMBODIMENTS

Figure 1:
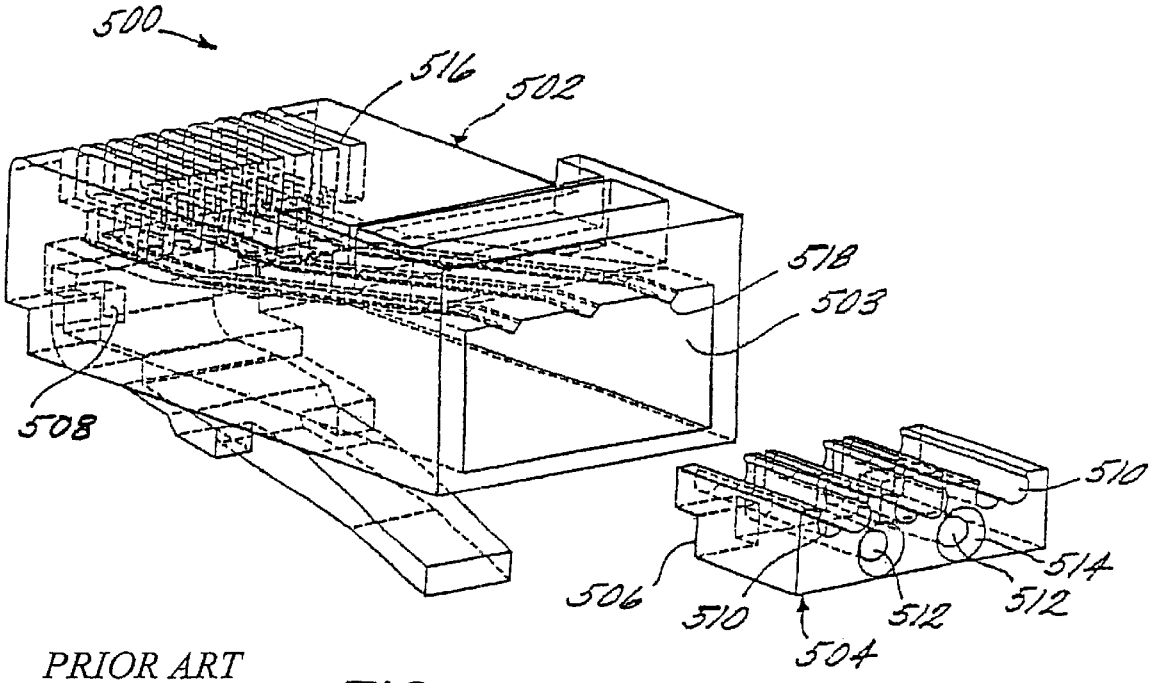
PRIOR ART FIG. 1
FIG. 1 is an exploded perspective view of a plug.

FIG. 1 is an exploded, perspective view of a plug shown generally at 500 designed to provide more consistent performance. Plug 500 includes a housing 502 and a load bar 504. The housing is designed to mate with already existing RJ45 outlets (i.e., backwards compatibility). As will be described in more detail below, load bar 504 receives wires and positions the wires in proper locations for reducing crosstalk. Load bar 504 is inserted through opening 503 in housing 502. Load bar 504 is generally rectangular and includes recesses 506 that receive shoulders 508 formed in the interior of housing 502. Load bar 504 includes a first set of wire receiving channels 510 arranged in a first plane and a second set of wire receiving channels 512 positioned in a second plane different from the first plane. In a preferred embodiment, the first plane is substantially parallel to the second plane. The wire receiving channels 510 are wide enough to slip the wires in, but narrow enough, that once the wires are in position the wires are held in place during the loading process. Wire receiving channels 512 include a tapered entrance 514 to facilitate installation of the wire. A series of separate slots 516 are formed in the housing 500 for providing a path for an insulation displacement contact to contact wires positioned in wire receiving channels 510 and 512. The slots 516 are separate thereby preventing adjacent insulation displacement contacts from touching each other. Three ridges 518 are formed on the inside of housing 502. Each ridge 518 is positioned between two adjacent wire receiving channels 510 and aids in positioning the wires relative to slots 516. The load bar 504 shown in FIG. 1 is designed to receive eight wires, six in the first plane and two in the second plane. It is understood that the plug 500 can be modified to receive more or less wires without departing from the invention.

Figure 2:
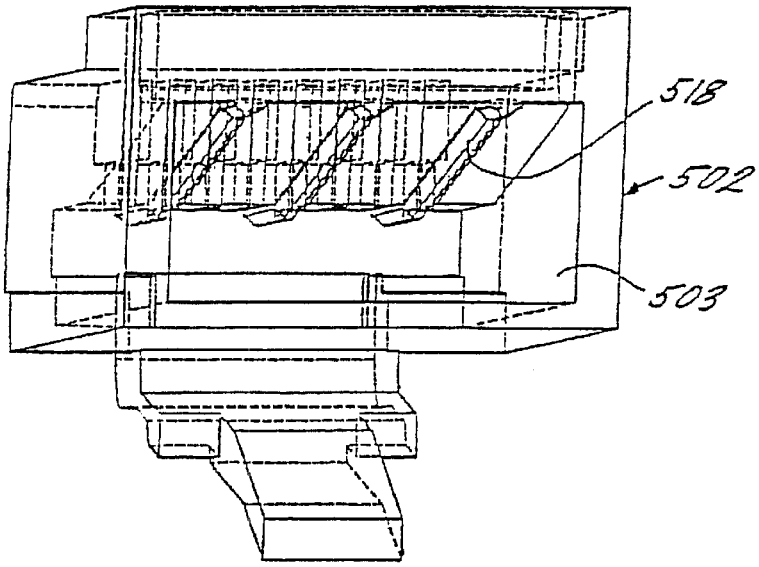
FIG. 2 PRIOR ART
FIG. 2 is a perspective view of the housing of the plug in FIG. 1.

FIG. 2 is a perspective view of the housing 502. Ridges 518 angle downwards towards the load bar and then proceed parallel to the wire receiving channels 510 in load bar 504. The angled opening in housing 502 facilitates insertion of the load bar 504 into housing 502.

FIG. 3 is a perspective view of the load bar 504. Each wire receiving channel 510 is semi-circular. Adjacent wire receiving channels 510 receive a tip and ring conductor from a respective pair and have a lip 520 positioned therebetween to position the wires accurately. A barrier 522 is provided between adjacent pairs of wire receiving channels 510. Barriers 522 help keep tip and ring conductors from different pairs from being crossed and have a height greater than that of the wires. Barriers 522 are positioned directly above wire receiving channels 512 in the second plane.

As shown in FIG. 3, wire receiving channels 512 straddle a central pair of wire receiving channels 510 in accordance with conventional wiring standards. Barriers 522 include slots 524 formed through the top surface of barrier 522 and entering wire receiving channel 512. Slots 524 provide an opening for an insulation displacement contact to contact wires placed in wire receiving channels 512. Slots 524 are aligned with slots 516 in housing 502 when the load bar 504 is installed in the housing.

FIG. 4 is an end view of plug 500 with the load bar 504 installed in the housing 502. Ridges 518 include opposed semi-circular surfaces that have a similar radius to the semicircular surface of wire retaining channels 510. Opposed semi-circular surfaces 526 help position the wires in the wire receiving channels 510 so that the wires are aligned with the slots 516 in housing 502. A first surface 526 is directed towards one of the wire receiving channels 510 and the opposite surface 526 is directed towards the other wire receiving channel 510 of a pair of adjacent wire receiving channels. Ridges 518 are substantially parallel to wire receiving channels 510 and extend along the entire length of the wire receiving channels 510. Insulation displacement contacts are positioned in slots 516 and engage the wires in wire receiving channels 510 and 512. As is known in the art, longer insulation displacement contacts are needed to engage the wires in wire receiving channels 512.

Figure 5A:
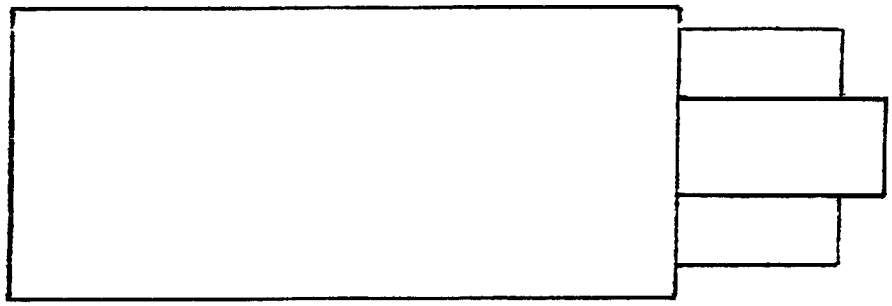
FIG. 5A PRIOR ART
FIG. 5A is a side view of a cable.
Figure 5B:
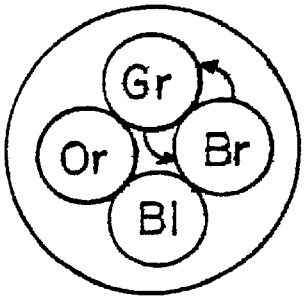
PRIOR ART FIG. 5B
FIG. 5B is an end view of one end of the cable.
Figure 5C:
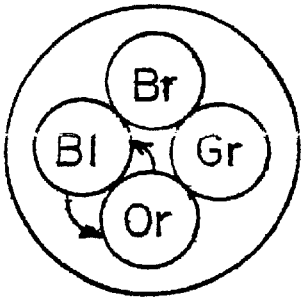
PRIOR ART FIG. 5C
FIG. 5C is an end view of another end of the cable.

Installation of wires in the load bar 504 will now be described. FIGS. 5A and 5B are side and end views, respectively, of a cable having four pairs of wires. The four pairs are labeled Gr (green), Br (brown), Bl (blue) and Or (orange). Each pair includes two wires, one wire designated the tip conductor and the other wire designated the ring conductor. In the un-installed state, the individual wires of each pair are twisted (i.e. the tip and ring conductors are twisted around each other). FIG. 5C is an end view of the opposite end of the cable shown in FIG. 5B.

Figure 6:
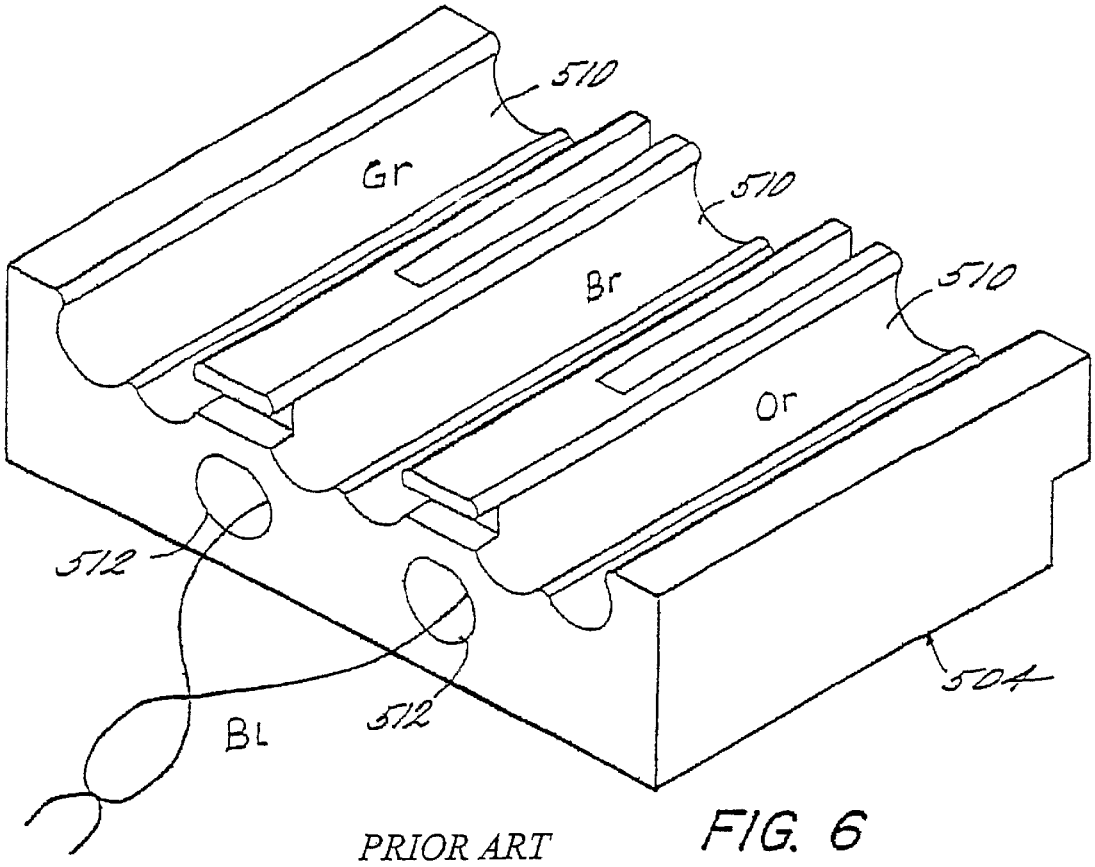
PRIOR ART FIG. 6
FIG. 6 is perspective view of the load bar of the plug of FIG. 1.

For the end of the cable shown in FIG. 5B, the load bar 504 will be loaded in the following way. First, the cable jacket will be stripped off approximately 1. 5" from the end. Next, pairs Br and Gr will be swapped in position as shown in FIG. 5B. To do this, pair Gr will cross between pair Br and pair Bl. This will create a separation between pair Br and the split pair Bl. Pair Bl is referred to as the split pair because it is spread over an intermediate pair in conventional wiring standards. As shown in FIG. 6, pair Br is positioned between the conductors of the split pair Bl. The tip and ring wires of the Bl pair will be untwisted up to a maximum of 0.5" from the cable jacket, such that the wires in the pair are oriented correctly. The Bl pair will then be laced into the load bar 504 in wire receiving channels 512 as shown in FIG. 6, and pulled through until the twisted wires contact the load bar. The remaining pairs Or, Br and Gr will be untwisted as little as necessary and placed in their appropriate wire receiving channels 510 such that no pairs are crossed. The tip and ring conductors for each pair are kept adjacent in wire receiving channels 510. The wires are then trimmed as close to the end of the load bar 504 as possible.

The pairs that are kept together, Or, Br and Gr are positioned in the first plane of wire receiving channels 510. The split pair Bl that straddles another pair Br, in accordance with conventional wiring standards, is placed in the second plane of wire receiving channels 512. The split pair Bl usually contributes greatly to near end crosstalk (NEXT). By positioning this pair in a second plane defined by wire receiving channels 512, separate from the first plane defined by wire receiving channels 510, the crosstalk generated by the split pair is reduced.

For the end of the cable shown in FIG. 5C the load bar will be loaded in the following way. First, the cable jacket will be stripped off approximately 1.5" from the end. Next pair Or and pair Bl will be swapped in position as shown in FIG. 5C. To do this, pair Or will cross between pair Br and pair Bl. This will create a separation between pair Br and the split pair Bl. The wires are then placed in the load bar 504 as described above.

The load bar 504 is then inserted into the housing 502. There is a slight interference fit between the load bar 504 and the housing 502 that secures the load bar 504 to the housing 502. Recesses 506 receive shoulders 508 in the housing 502. When the load bar 504 is properly positioned in the housing, wire receiving channels 510 are aligned with slots 516. The two slots 524 and two wire receiving channels 512 are also aligned with two slots 516. Contact blades having insulation displacement ends are then positioned in slots 516 and crimped so as to engage the wires in the wire receiving channels 510 and 512. It is understood that the contact blades for the split pair positioned in wire receiving channels 512 will be longer than the contact blades for the wires positioned in wire receiving channels 510. Telecommunications plug 500 provides several advantages. First, the amount of untwist in each pair is minimized and controlled by the load bar. The location of each pair is also regulated by the load bar and the load bar prevents buckling of wires because the wires do not have to be pushed into the plug. Thus, the plug has a very small and consistent range of transmission performance. This is advantageous particularly when crosstalk compensation circuitry must be tuned to the plug performance. Terminating the wire inside the load bar creates a more simple final assembly.

Figure 7:
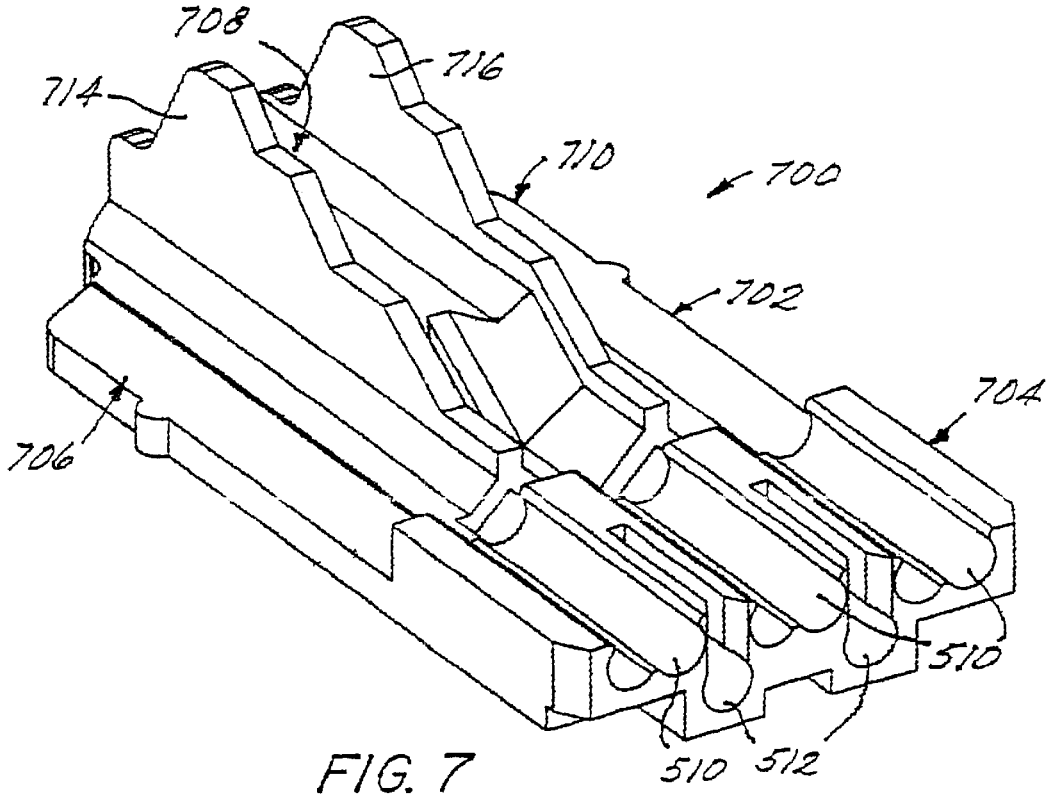
FIG. 7 is a perspective view of a shielded plug insert.

FIG. 7 is a perspective view of the top of a plug insert shown generally at 700 in an exemplary embodiment of the invention. Plug insert 700 includes a shielded isolator 702 coupled to a load bar 704. The load bar 704 is similar to load bar 504 described above and is used to position the individual wires for termination with insulation displacement contacts as described herein. The isolator 702 is connected to the load bar 704 and is conductive to provide for shielding between tip and ring pairs as described in detail previously. The isolator 702 may be made from plastic and integrally formed along with load bar 704. The isolator 702 may then be metallized using existing techniques. Alternatively, the isolator 702 may formed from a conductive polymer or made from metal.

Figure 8:
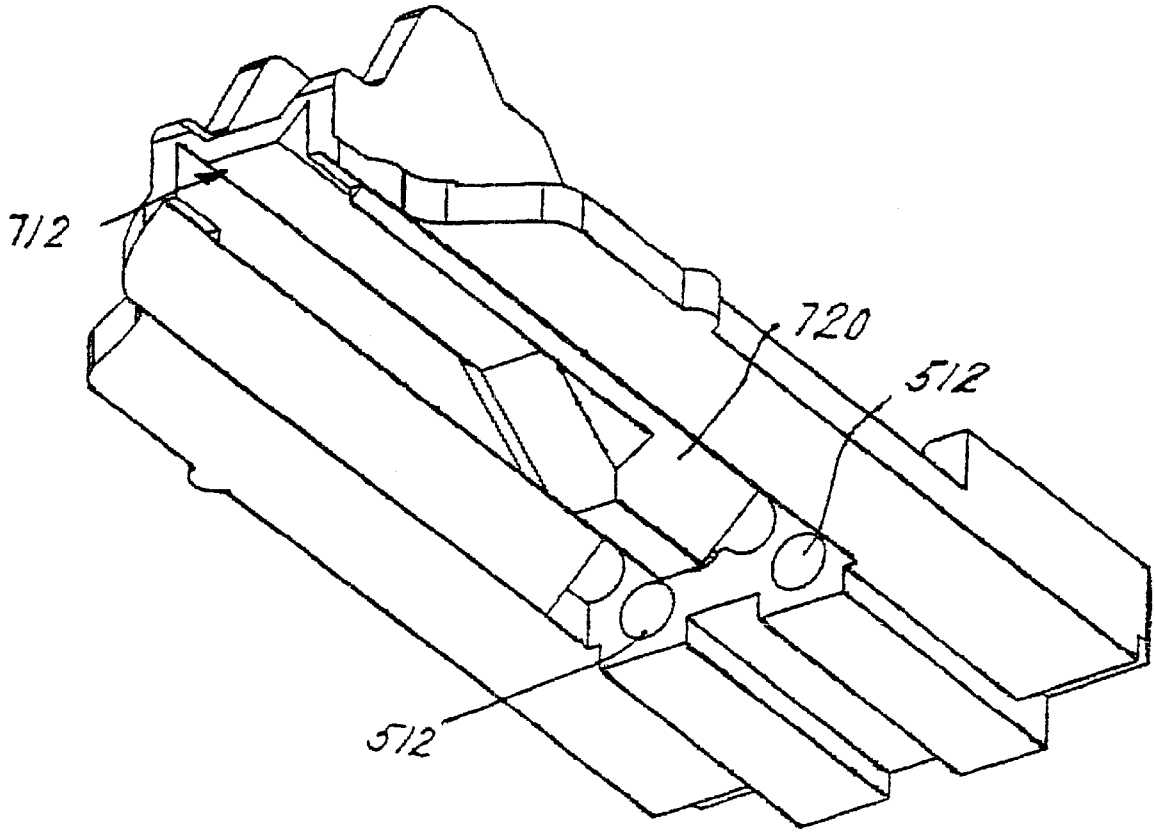
FIG. 8 is a perspective view of a shielded plug insert.

The isolator 702 includes separate shielded areas each for receiving a tip and ring pair to isolate the pairs from each other. As shown in FIG. 7, the isolator 702 includes three shielded areas 706, 708 and 710 on one side of the isolator 702. A fourth shielded area 712 is provided on the other side of the isolator as shown in FIG. 8. Shielded areas 706, 708 and 710 are separated by shield walls 714 and 716 that extend away from the shielded areas parallel to the longitudinal axis of the pairs of wires in each shielded area 706, 708 and 710. Although FIGS. 7 and 8 depict three shielded areas on one side of the isolator 702 and one shielded area on the other side of the isolator 702, it is understood that this arrangement may be varied. All four shield areas may be positioned on one side of the isolator 702. In addition, more or less than four shield areas may be used depending on the number of pairs in the cable.

FIG. 8 is a perspective view of the bottom of the plug insert 700 depicting shielded area 712. In the embodiment shown in FIG. 8, the shielded area 712 receives conductors of the split pair (e.g., conductors 3 and 6 in T568A standard) and includes a pyramid-shaped projection 720 that facilitates separation of the tip and ring conductors of the split pair and facilitates aligning the individual conductors with wire receiving channels 512. The shielded area 712 is on the bottom side of the isolator 702 which provides isolation from shielded areas 706, 708 and 710.

Figure 9:
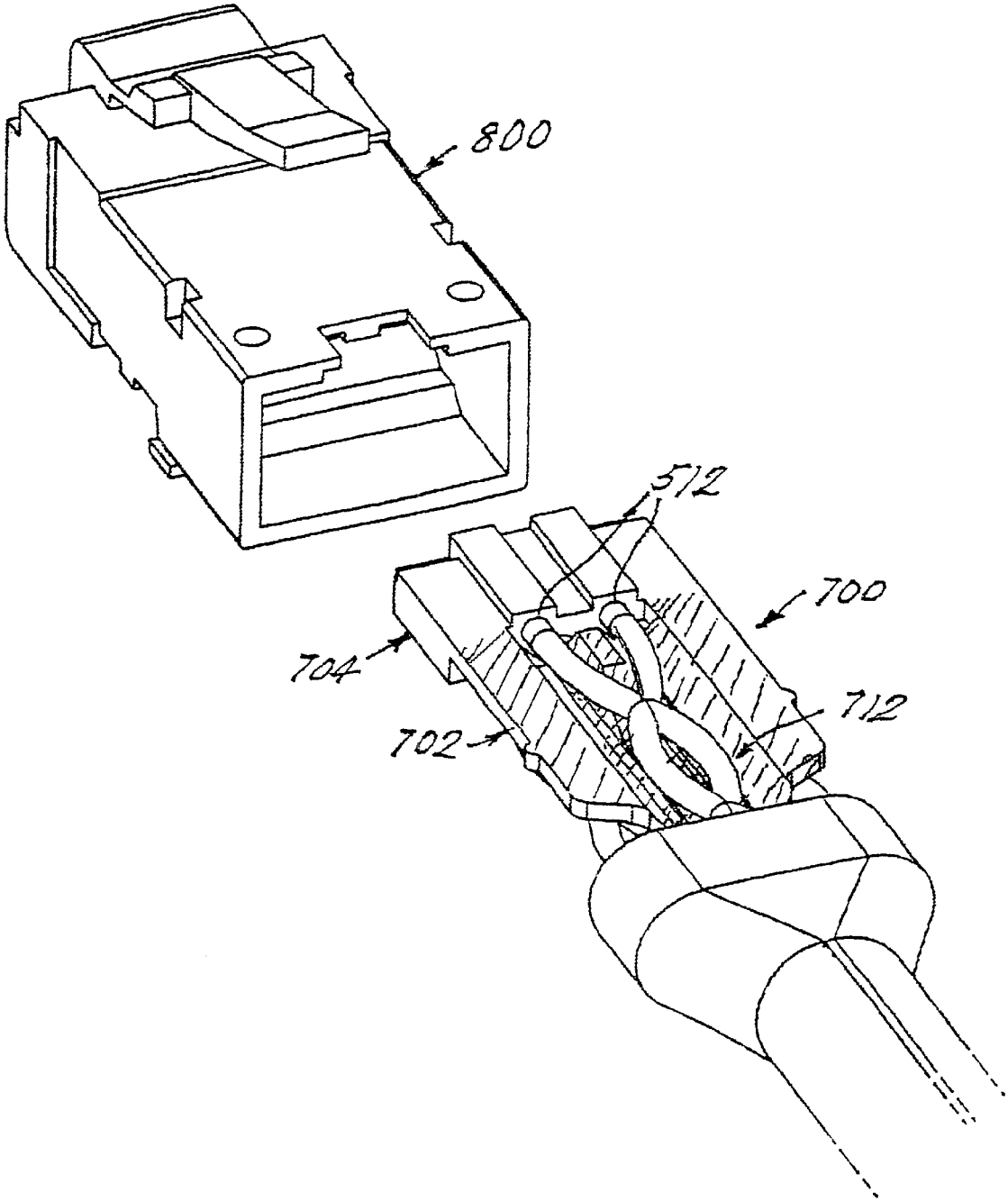
FIG. 9 is a perspective view of a shielded plug insert coupled to a cable and a housing.

FIG. 9 is a perspective view of the bottom of the plug insert 700 having a cable installed therein. The isolator 702 is cross hatched in FIG. 9. The plug insert 700 is used with cable divided into a plurality of pairs, each pair having a tip and ring conductor as is known in the art. Each pair is placed in a shielded area 706, 708, 710 or 712 to isolate the pairs from each other and reduce cross talk. FIG. 9 depicts a split pair (e.g., conductors 3 and 6) installed in shielded area 712. The conductors are placed in the shielded area 712 and then inserted in wire receiving channels 512 in the load bar 704 as described above with reference to load bar 504. The plug insert 700 is the mounted in a housing 800 as described below.

Figure 10:
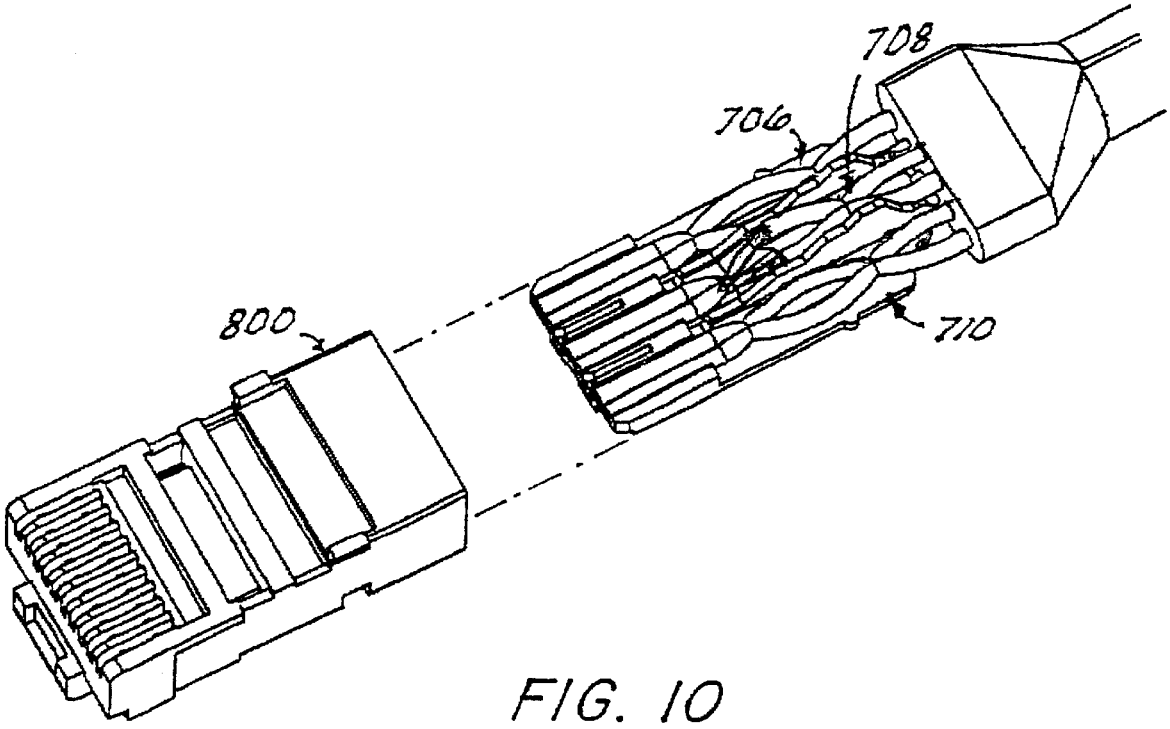
FIG. 10 is a perspective view of a shielded plug insert coupled to a cable and a housing.

FIG. 10 is a perspective view of the top of the plug insert 700 having a cable installed therein. As shown in FIG. 10, a pair of conductors (i.e., a tip and ring pair) is positioned in each of the shielded areas 706, 708 and 710. The shield walls 714 and 716 are generally parallel to the longitudinal axis of the conductors and have a height greater than the conductors so as to isolate pairs. A pair of conductors is placed in each shielded area 706, 708 and 710 and then inserted in wire receiving channels 510 as described above with reference to load bar 504.

As shown in FIGS. 9 and 10, the pairs may be twisted in each of the shielded regions 706, 708, 710 and 712. Because each pair is shielded from adjacent pairs, the pair untwist may begin at any location in the isolator 702. Conventional designs require the assembler to control the amount of untwist very accurately which leads to increased assembly time and variable plug performance. With the plug insert 700, the pair untwist may begin anywhere in the isolator 702 and thus, less precise control of pair untwist is needed. This reduces manufacturing time and provides more consistent plug performance.

Figure 11:
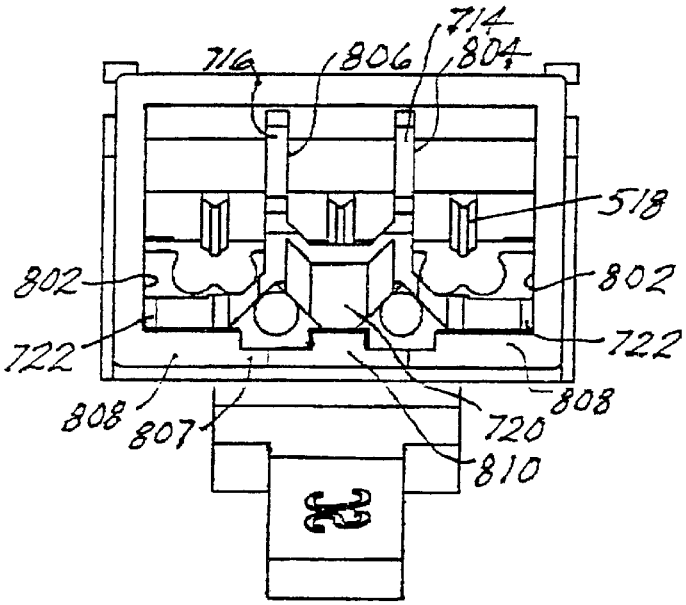
FIG. 11 is an end view of the shielded plug insert mounted in the housing.

FIG. 11 is an end view of the plug insert 700 mounted in the housing 800. The plug insert 700 and housing 800 include structure to contain the pairs in each shielded area. Side walls 722 of the isolator 702 abut against the interior of side walls 802 of housing 800. Shield walls 714 and 716 are received in slots 804 and 806, respectively. The interior of bottom wall 807 of housing 800 includes two raised ribs 808 which straddle shielded area 712. The bottom of isolator 702 abuts against ribs 808 to contain the conductors in shielded area 712. In addition, the bottom wall 807 includes a central rib 810 which contacts projection 720 to contain the individual conductors of the split pair in the shielded area 712.

Figure 12:
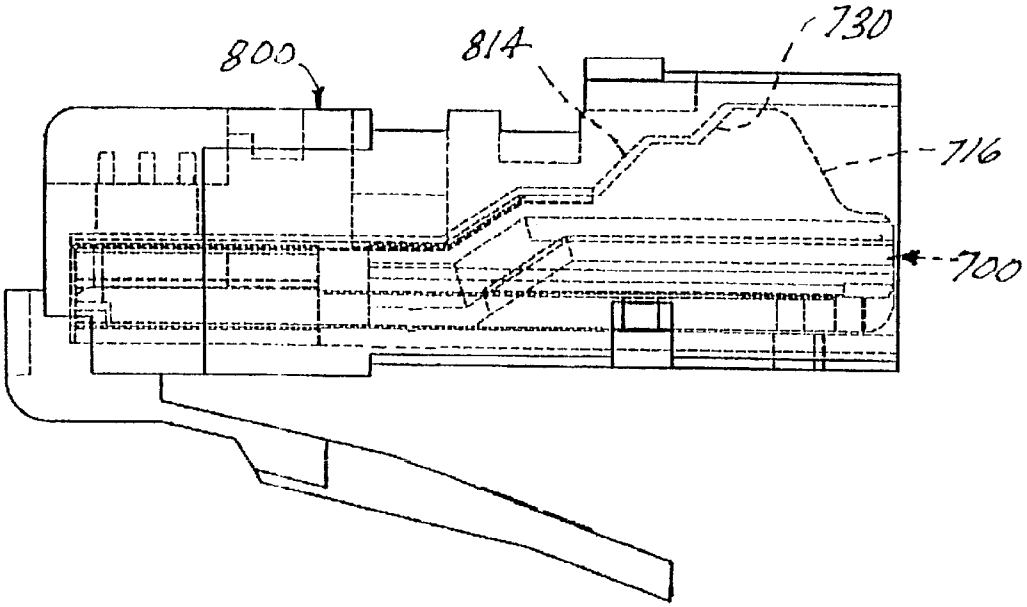
FIG. 12 is a view of the shielded plug insert mounted in the housing.

FIG. 12 is a side view of the plug insert 700 mounted in housing 800. As shown in FIG. 12, the shield wall 716 has a top surface 730 which complements or follows the inside top surface 814 of housing 800. Shield wall 714 is similarly formed. This helps contain wires in the shielded areas 706, 708 and 710.

Figure 13:
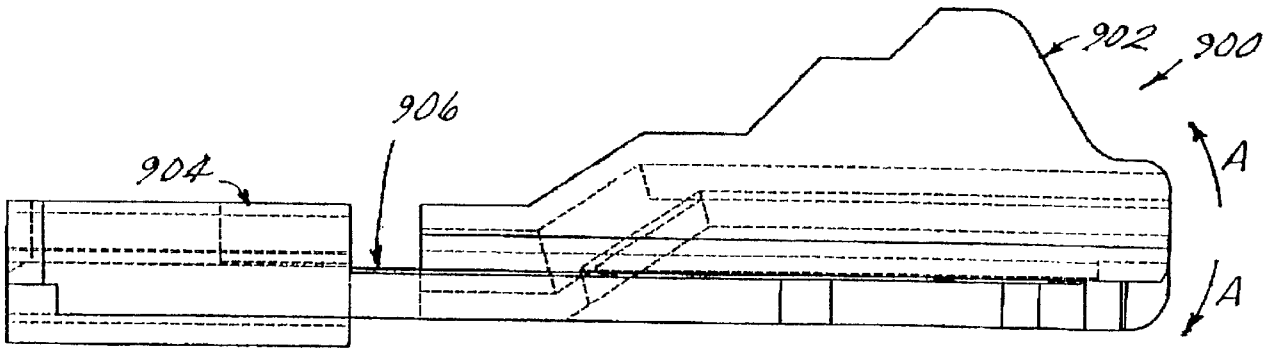
FIG. 13 is a side view of an alternative shielded plug insert.
Figure 14:
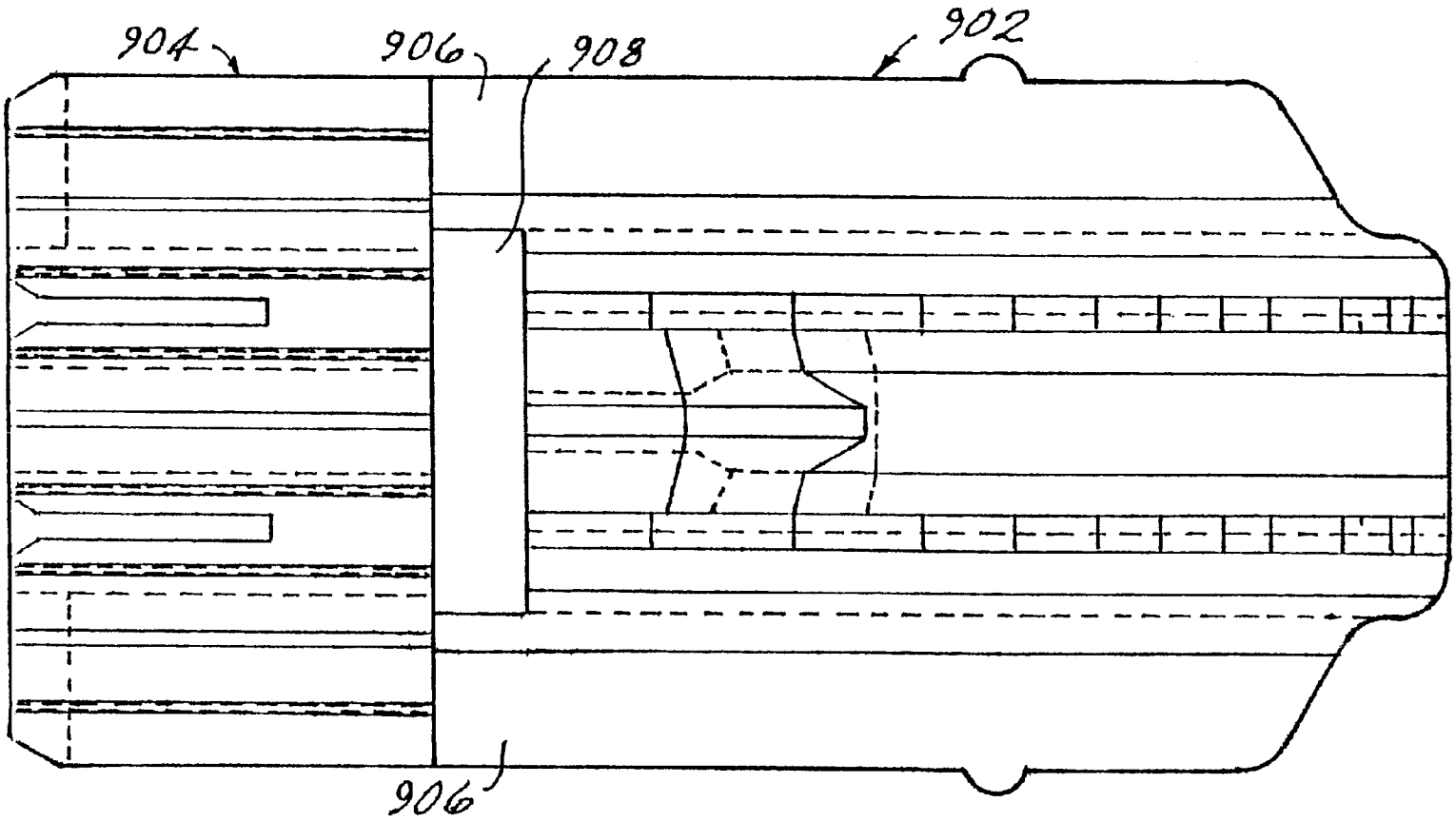
FIG. 14 is a top view of the alternative shielded plug insert.

FIG. 13 is a side view and FIG. 14 is a top view of an alternative plug insert 900. The plug insert 900 includes a isolator 902 and a load bar 904 similar to isolator 702 and load bar 704 described above. Isolator 902 is joined to load bar 904 by two legs 906 having an opening 908 therebetween. The two legs 906 may be metallized along with isolator 902. The two legs 906 are formed as a living hinge to allow isolator 902 to rotate relative to load bar 904. The isolator 902 can bend out of the way of the load bar 904 to expose wire receiving channels 510 or 512 to facilitate insertion of conductors into load bar 904. The isolator 902 can rotate in two directions relative to load bar 902 as shown by arrows A in FIG. 13.

Figure 15:
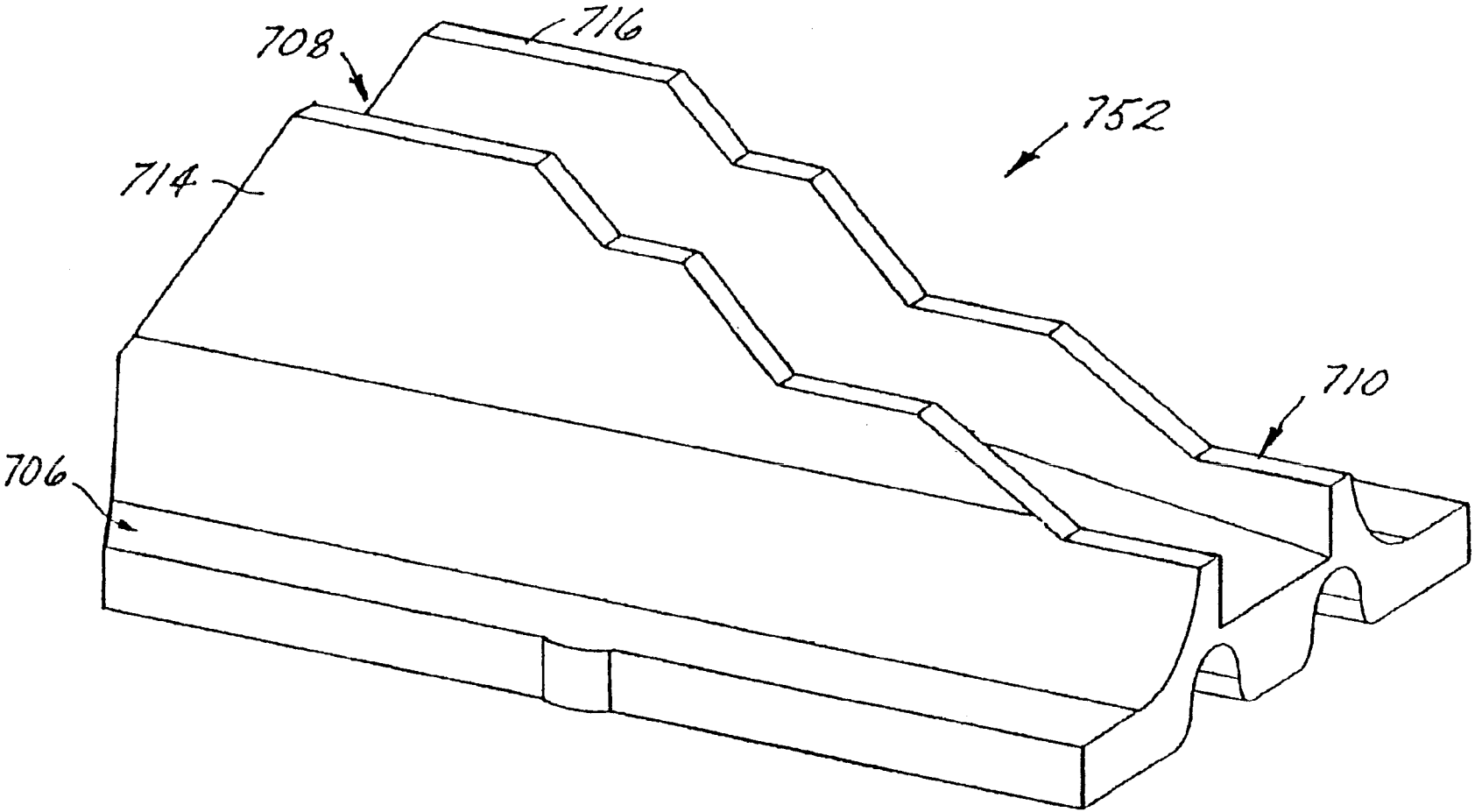
FIG. 15 is a perspective view of an alternate isolator.

FIG. 15 is a perspective view of an alternative isolator 752. Isolator 752 is similar to isolator 702 but is separate from load bar 704. Isolator 752 includes three shielded areas 706, 708 and 710 on one side of the isolator 702. A fourth shielded area 712 is provided on the other side of the isolator 752 similar to that shown in FIG. 8. Shielded areas 706, 708 and 710 are separated by shield walls 714 and 716 that extend away from the shielded areas parallel to the longitudinal axis of the pairs of wires in each shielded area 706, 708 and 710. Although FIG. 15 depicts three shielded areas on one side of the isolator 752 and one shielded area on the other side of the isolator 752, it is understood that this arrangement may be varied. All four shield areas may be positioned on one side of the isolator 752. In addition, more or less than four shield areas may be used depending on the number of pairs in the cable. The isolator 752 is conductive and separate from the load bar 704. The isolator 152 may be made from metallized plastic, metal or a conductive polymer.

Figure 16:
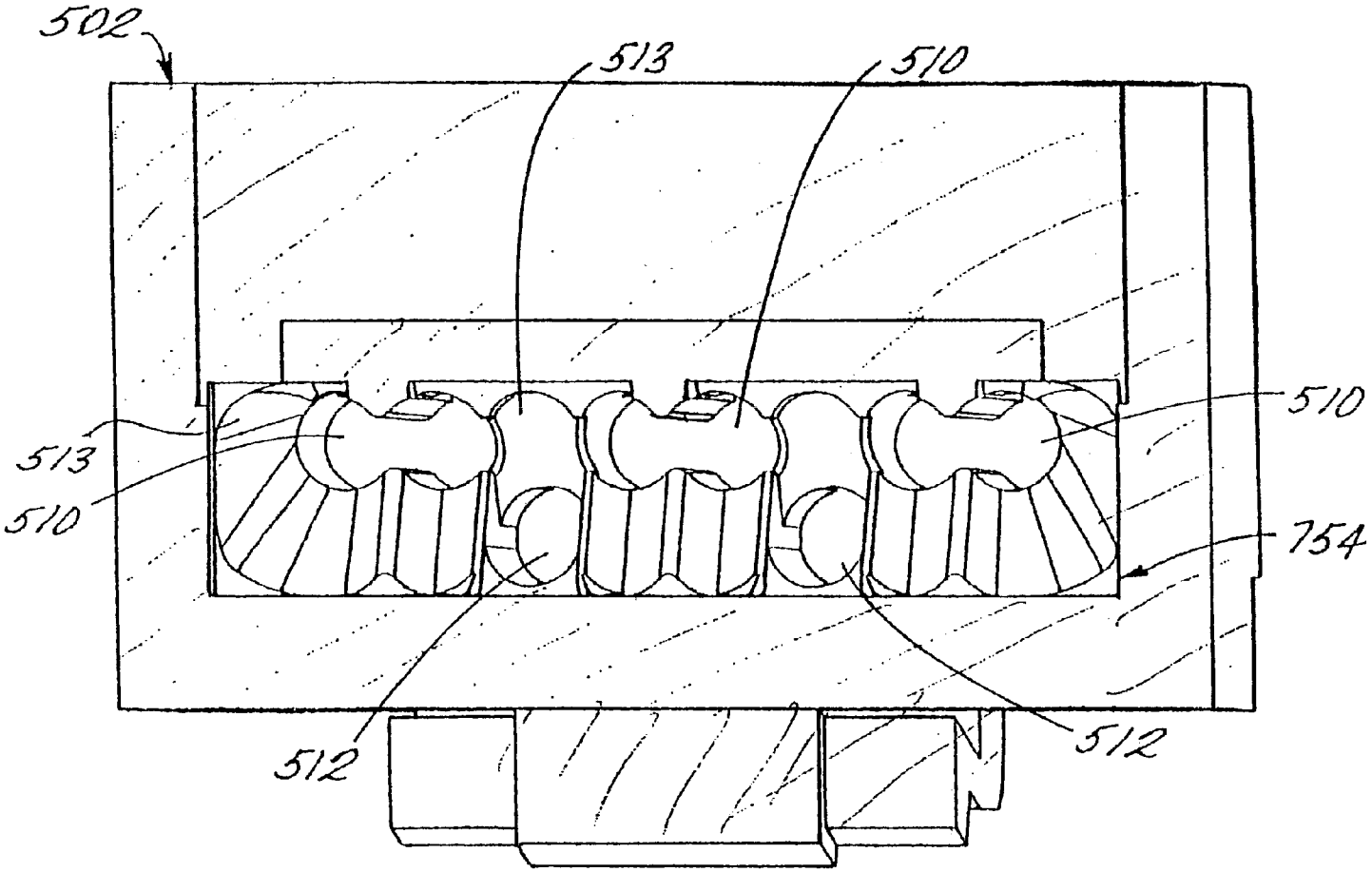
FIG. 16 is a cross-sectional, perspective view of an alternate housing.

FIG. 16 is a cross-sectional, perspective view of a housing 502 having an integrated load bar 754. The integrated load bar 754 is integrally formed with the housing 502. The integrated load bar 754 includes wire receiving channels 510 and wire receiving channels 512 as described above. The wire receiving channels 510 and 512 include tapered lead-in surfaces 513 to facilitate insertion of the wires in the wire receiving channels 510 and 512.

Figure 17:
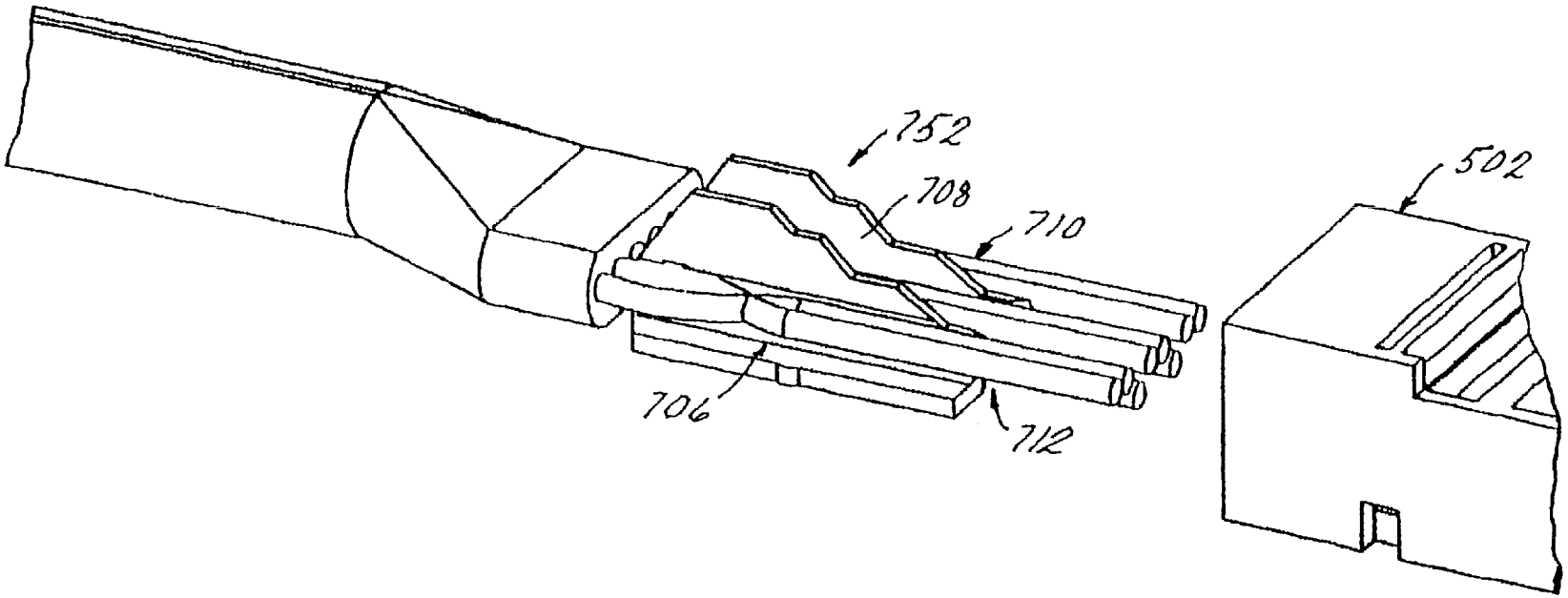
FIG. 17 is a perspective view of the loading of the isolator of FIG. 15.

Assembly of the connector having the isolator of FIG. 15 and the integrated load bar of FIG. 16 is depicted in FIG. 17.

The wires are placed into their respective shield areas 706, 708, 710 and 712 in the isolator 752 as shown in FIG. 17. The isolator 752 is then inserted into the plug housing 502 so that the wires enter the appropriate wire receiving channels.

Figure 18:
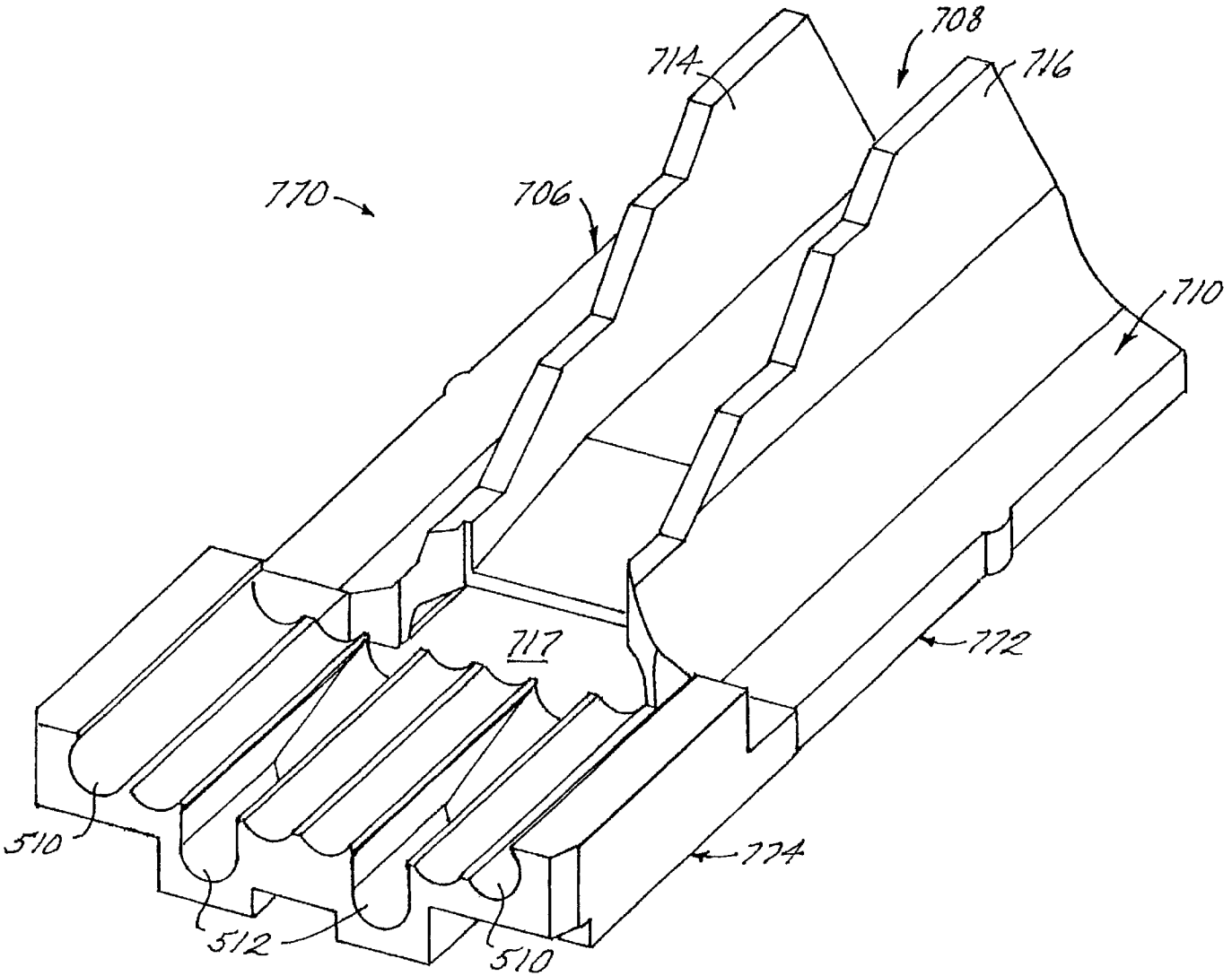
FIG. 18 is a perspective view of another alternate plug insert.
Figure 19:
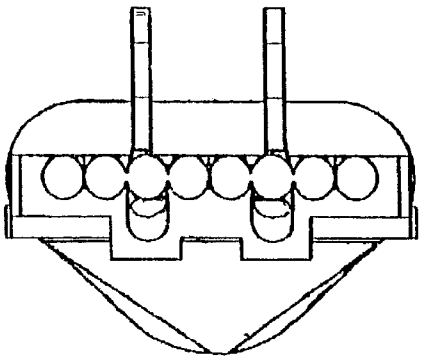
FIG. 19 is a front view of the plug insert of FIG. 18.

FIG. 18 is a perspective view of an alternate plug insert shown generally at 770. The plug insert 770 is similar to plug insert 700 but uses a different load bar 774 and different isolator 772. Load bar 774 is designed to allow an installer to align all eight wires in the load bar 774 in a single line as shown in FIG. 19. The barriers 522 above wire receiving channels 512 are removed and wires are installed in the plug insert 770 in a single line as shown in FIG. 19. The wires for positions 3 and 6 are positioned above wire receiving channels 512. The wires corresponding to positions 3 and 6 pass under the shield area 708 and emerge through opening 717 to be placed in line or in a common plane with the other wires. The wires for positions 3 and 6 are still isolated from the other wires by being positioned on the bottom of the isolator 702 as opposed to the top of the isolator.

Figure 21:
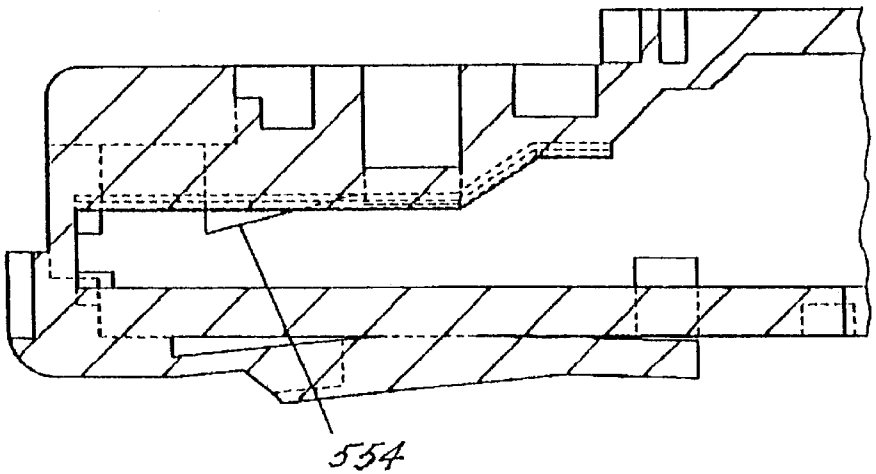
FIG. 21 is a cross-sectional view of the housing taken along line 21—21 of FIG. 20.
Figure 20:
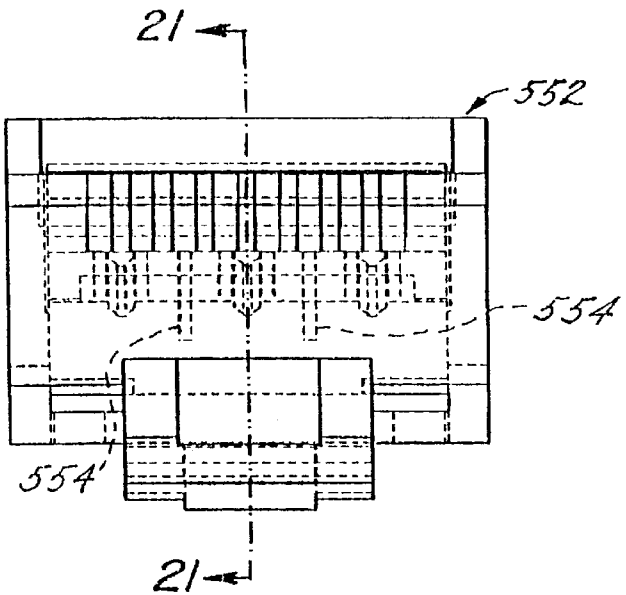
FIG. 20 is a front view of a housing for use with the plug insert of FIG. 18.

The plug insert 770 is used with a plug housing 552 shown in FIG. 20. As shown in FIG. 20, the plug housing 552 is similar to plug housing 502. Plug housing 552 includes protrusions 554 on the inside, top surface of the housing 552. The protrusions 554 are also shown in the cross-sectional view in FIG. 21. In the embodiment shown in FIG. 21, the protrusions 554 are triangular. It is understood that other shapes may be used and the invention is not limited to triangular protrusions. The protrusions 554 are positioned to contact wires in positions 3 and 6 above wire receiving channels 512 and direct the wires in positions 3 and 6 downwards and away from the wires in positions 1, 2, 4, 5, 7 and 8. As noted above, the wires are typically grouped in tip and ring pairs in which wires 1 and 2 form a pair, wires 4 and 5 form a pair, wires 3 and 6 form a pair and wires 7 and 8 form a pair. The protrusions 554 separate the wires in positions 3 and 6 from the remaining wires thereby reducing crosstalk as described above.

Figure 22:
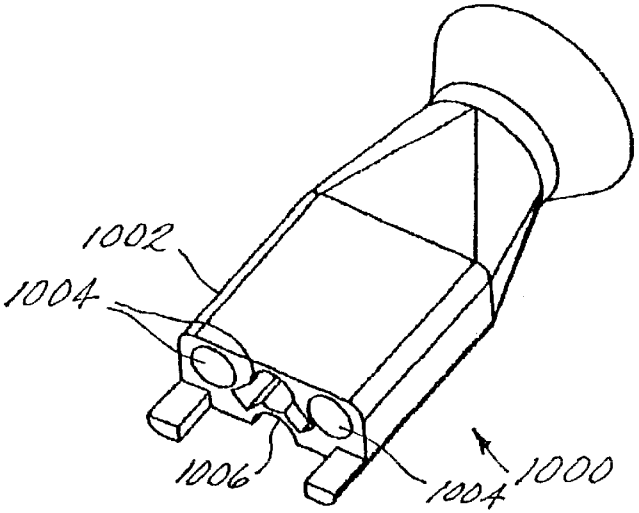
FIGS. 22–24 are views of another alternate isolator.
Figure 24:
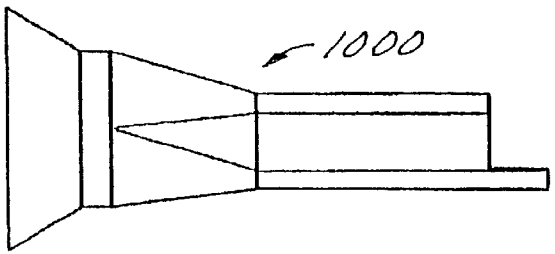
Figure 23:
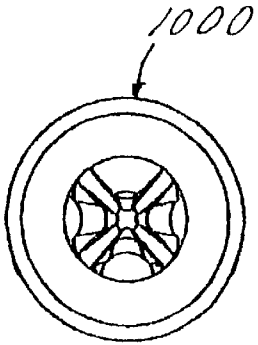

FIGS. 22–24 are views of an alternate isolator 1000 which provides 360 degree shielding to multiple pairs. The isolator 1000 is conductive and may be from plastic which is then metallized, a conductive polymer or metal. As shown in FIG. 22, the isolator 1000 includes a body 1002 having a plurality of enclosed channels 1004 formed through the body 1002. Each channel 1004 receives a pair of wires to isolate the pairs from each other. The enclosed channels 1004 completely surround wire pairs and provide 360 degree shielding. Also formed in the body 1002 is a groove 1006 which receives a wire pair. The groove 1006 does not provide 360 degree shielding but surrounds approximately 180 degrees of the wire pair.

Figure 25:
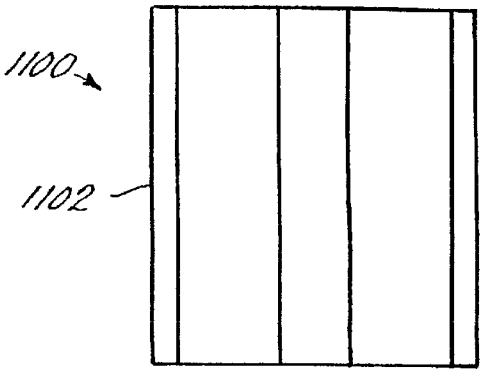
FIGS. 25–26 are views of another alternate isolator.
Figure 26:
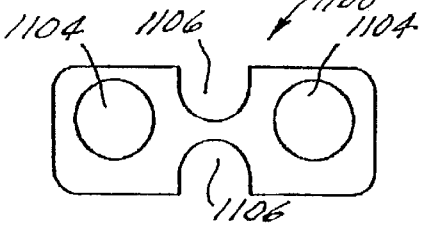

FIGS. 25 and 26 are views of an alternate isolator 1100. The isolator 1100 is conductive and may be made from plastic which is then metallized, a conductive polymer or metal. As shown in FIGS. 25 and 26, the isolator 1100 includes a body 1102 having a plurality of enclosed channels 1104 formed through the body 1102. Each channel 1104 receives a pair of wires to isolate the pairs from each other. The enclosed channels 1104 completely surround wire pairs and provide 360 degree shielding. Also formed in the body 1102 are grooves 1106, each of which receives a wire pair. The grooves 1106 do not provide 369 degree shielding but surround approximately 180 degrees of the wire pair.

Figure 27:
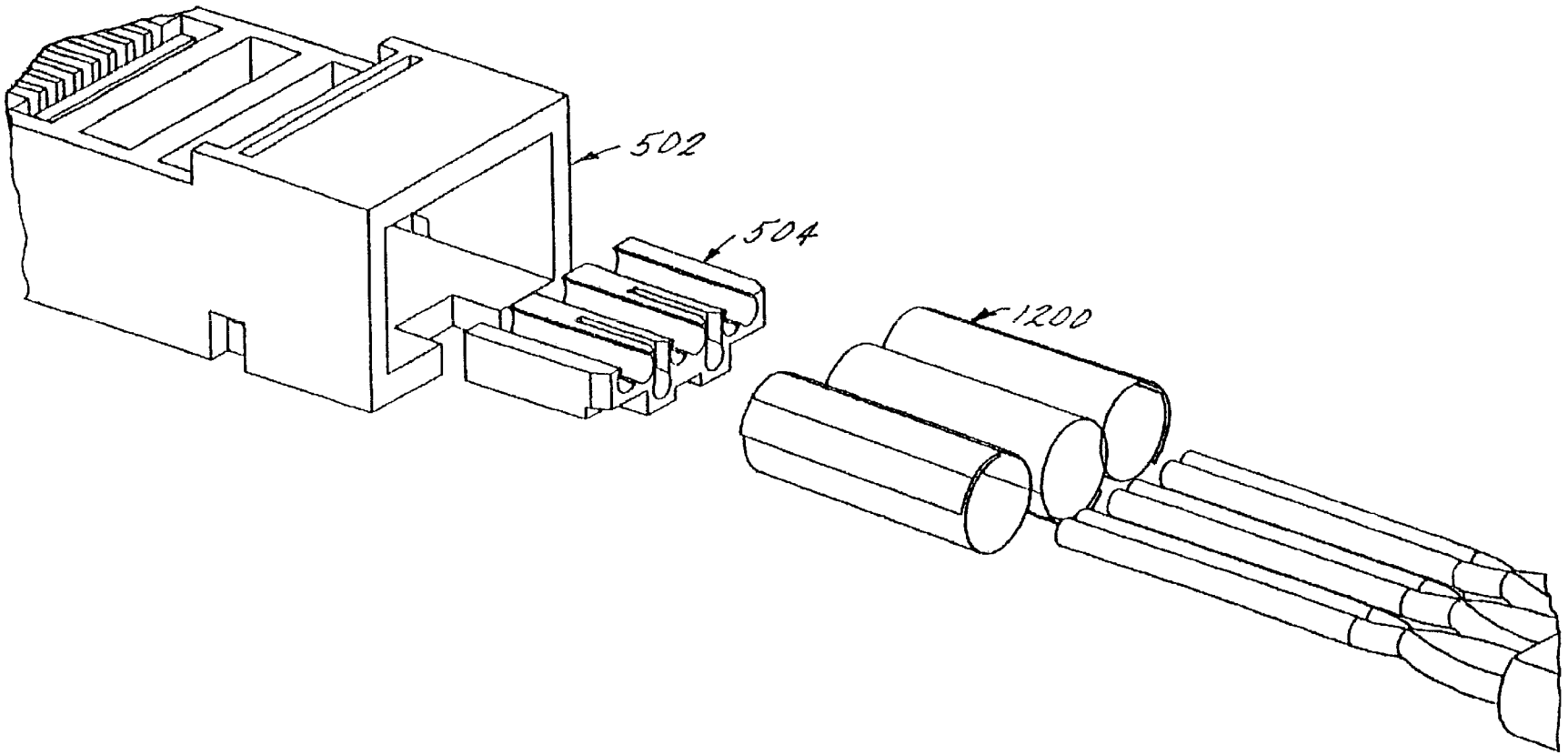
FIG. 27 is a perspective view depicting individual shield members as isolators.

FIG. 27 is a perspective view of another embodiment of the invention. As shown in FIG. 27, the connector includes a plug housing 502 as described above and a load bar 504 as described above. The connector also includes a plurality of isolation members 1200, each of which receives a wire pair. The isolation members 1200 are conductive and may be made from plastic which is then metallized, a conductive polymer, metal or metal foils. As shown in FIG. 27, the isolation members 1200 include three cylindrical tubes but it is understood that the isolation members may vary in shape and number. The isolation members 1200 surround the wire pairs and thus provide 360 degree shielding. As shown in FIG. 27, the three isolation members 1200 will receive wires pairs 1–2, 4–5 and 7–8, respectively. The wire pair 3–6 will be routed beneath the isolation members 1200.

Figure 28:
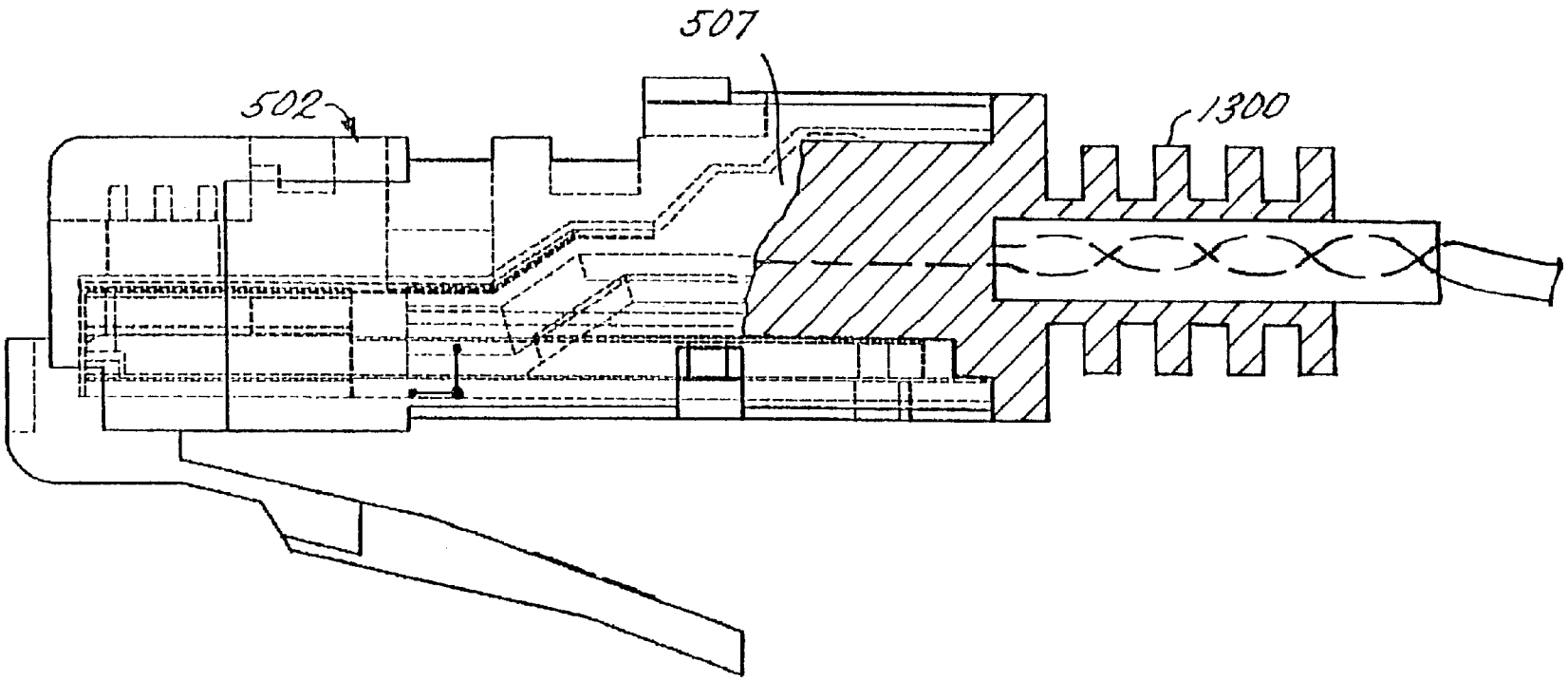
FIG. 28 is a partial cross-sectional view of a housing with an overmolded boot.

The electrical performance of the plug may be adjusted using an overmolded boot. Overmolded boots are known in the art for sealing the rear end of the plug housing and providing strain relief such as that disclosed in published International Patent application WO 99/00879. FIG. 28 is a partial cross-sectional view of a plug having an overmolded boot 1300. The wires enter the plug housing and are positioned in an internal cavity 507 in the housing 502. The material used to overmold the boot 1300 enters the interior cavity 507 of the housing 502 and surrounds the wires. The load bar may be configured to prevent the overmold material from reaching the portion of the wires that receive IDC's. The overmold material may be an insulator to adjust the dielectric constant of the plug or a conductive polymer (e.g., an intrinsically conductive plastic, plastic including a conductive filler, etc.) to provide shielding to the wires. If the overmold material is conductive, it serves as the isolator.

The embodiments described herein are for use with eight conductors (i.e., four twisted pairs) but it is understood that the invention may be used with any number of conductors and is not limited to eight.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A telecommunications plug for use with a cable having a plurality of wires arranged in a plurality of pairs, the telecommunications plug including:

a housing;

a load bar positioned within said housing, said load bar positioning said wires relative to each other; and an isolator positioned in said housing, said isolator being conductive and including an isolator body having an isolator top and an isolator bottom, a first enclosed channel containing a first pair of wires, a second enclosed channel containing a second pair of wires, a third pair of wires positioned on said isolator top and a fourth pair of wires positioned on said isolator bottom, said third pair of wires and said fourth pair of wires being positioned between said first enclosed channel and said second enclosed channel.

2. The telecommunications plug of claim 1 wherein said isolator is made from metal.

3. The telecommunications plug of claim 1 wherein said isolator is made from plastic coated with a conductor.

4. The telecommunications plug of claim 1 wherein said isolator is made from conductive plastic.

5. The telecommunications plug of claim 1 wherein said isolator top includes a groove formed therein, said groove partially surrounding said third pair of wires received in said groove.

6. The telecommunications plug of claim 5 wherein said isolator bottom includes a further groove formed therein, said further groove partially surrounding said fourth pair of wires received in said further groove.

7. A telecommunications plug for use with a cable having a plurality of wires arranged in a plurality of pairs, the telecommunications plug including:

a housing;

a load bar positioned within said housing, said load bar positioning said wires relative to each other;

a plurality of contacts for establishing electrical contact with said wires; and an isolator positioned in said housing, said isolator being conductive and isolating a first pair of wires from a second pair of wires wherein:

said load bar aligns a portion of said wires in a single plane; and said housing includes an insulative protrusion for contacting at least one of said wires and diverting said at least one of said wires away from said plane.

8. The telecommunications plug of claim 7 wherein said housing includes two protrusions.

9. The telecommunications plug of claim 8 wherein said wires are arranged in eight positions, said pairs include wires in positions 1 and 2, wires in positions 3 and 6, wires in positions 4 and 5 and wires in positions 7 and 8;

said protrusions contacting wires in positions 3 and 6.

* * * * *